US005388563A

United States Patent [19]

Hsu

[11] Patent Number: 5,388,563

[45] Date of Patent: Feb. 14, 1995

[54] INDEXED SCALE FASTENER WITH DAMPING MEANS FOR USE IN CONJUNCTION WITH AN ARCHERY BOW

[75] Inventor: Gary Hsu, Canoga Park, Calif.

[73] Assignee: Micro Inventions Technology Inc., West Hills, Calif.

[21] Appl. No.: 131,528

[22] Filed: Oct. 4, 1993

[51] Int. Cl.[6] ..... F41B 5/14; F41B 5/20

[52] U.S. Cl. ..... 124/23.7; 124/86; 124/89; 411/14

[58] Field of Search ..... 42/1.06; 411/8, 14, 411/389, 396, 397; 124/23.1, 24.1, 25.6, 86, 88, 89, 900

[56] References Cited

U.S. PATENT DOCUMENTS

| | | | |
|---|---|---|---|
| 2,830,486 | 4/1958 | Dillon . | |
| 3,060,731 | 10/1962 | Adise . | |
| 3,602,186 | 8/1971 | Popenoe . | |
| 3,814,075 | 6/1974 | Hoyt | 124/23.1 |
| 3,823,639 | 7/1974 | Liber . | |
| 3,886,840 | 6/1975 | Bossler . | |
| 4,054,121 | 10/1977 | Hoyt, Jr. . | |
| 4,091,790 | 5/1978 | Hoyt | 124/88 X |
| 4,201,177 | 5/1980 | Holman et al. . | |
| 4,201,182 | 5/1980 | Butler . | |
| 4,251,064 | 2/1981 | Camilleri | 267/136 |
| 4,310,149 | 1/1982 | Camilleri | 267/136 |
| 4,494,521 | 1/1985 | Quartino | 124/23.1 |
| 4,615,327 | 10/1986 | Saunders . | |
| 4,779,602 | 10/1988 | Hess, Sr. | 124/89 |
| 4,793,319 | 12/1988 | Vaughan et al. | 124/89 X |
| 4,936,283 | 6/1990 | Izuta | 124/89 |
| 4,945,666 | 8/1990 | Henry et al. | 42/1.06 |
| 4,982,719 | 1/1991 | Haggard et al. | 124/89 |
| 5,016,602 | 5/1991 | Mizek | 124/89 |
| 5,044,351 | 9/1991 | Pfeifer | 124/89 |
| 5,090,395 | 2/1992 | Gannon | 124/25.6 |
| 5,160,121 | 11/1992 | Bartholomew | 267/136 |
| 5,165,831 | 11/1992 | Yager et al. | 411/14 |
| 5,231,970 | 8/1993 | Ploot et al. | 124/23.1 |

FOREIGN PATENT DOCUMENTS

| | | | |
|---|---|---|---|
| 2242720 | 10/1991 | United Kingdom | 411/14 |

*Primary Examiner*—Eric K. Nicholson
*Assistant Examiner*—John A. Ricci
*Attorney, Agent, or Firm*—Thomas I. Rozsa; Tony D. Chen

[57] ABSTRACT

The present invention apparatus is a novel and unique combination of a damping member adapted to an indexed scale fastener for use with an archery bow. The indexed scale fastener and the damping member can be used together or separately. The damping member can be used at locations on the archery bow which are remote from the indexed scale fastener. The concept is to have the indexed scale fastener adapted to the conventional threaded openings where the prior art hex screws are located. A user can screw the indexed scale fastener to the archery bow and measure the poundage applied to the archery bow by simply reading the scale provided on the indexed scale fastener. The damping member can be threadedly mounted to the indexed scale fastener or to the archery bow, where the damping member absorbs the vibrations and shock in both the longitudinal and lateral directions caused by releasing of the arrow from the archery bow. The damping member also serves to dampen the sound of the archery bow and make the shooting of the arrow smoother.

48 Claims, 4 Drawing Sheets

FIG. 3
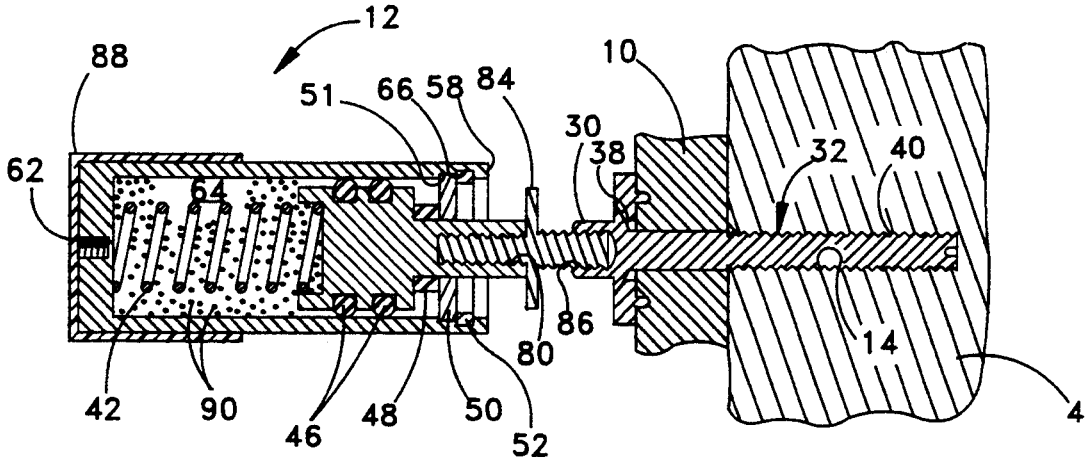
FIG. 4
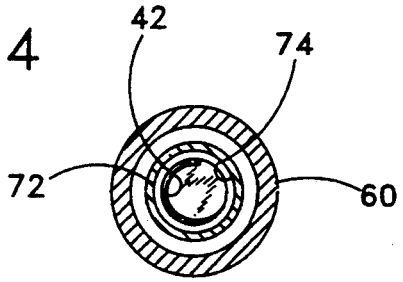
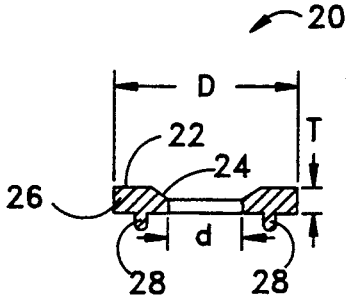
FIG. 5
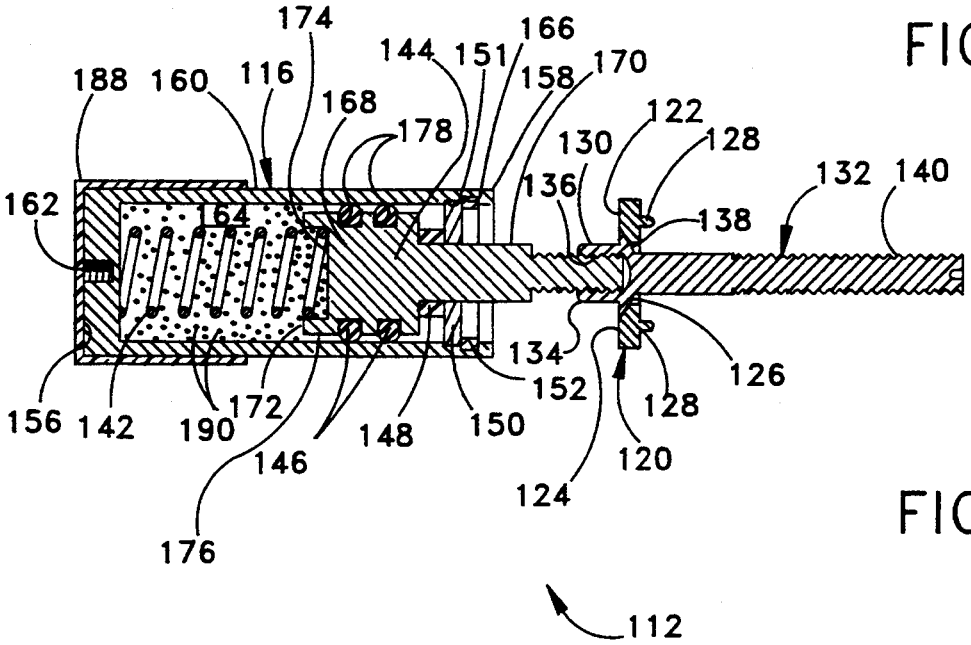
FIG. 6

FIG.13
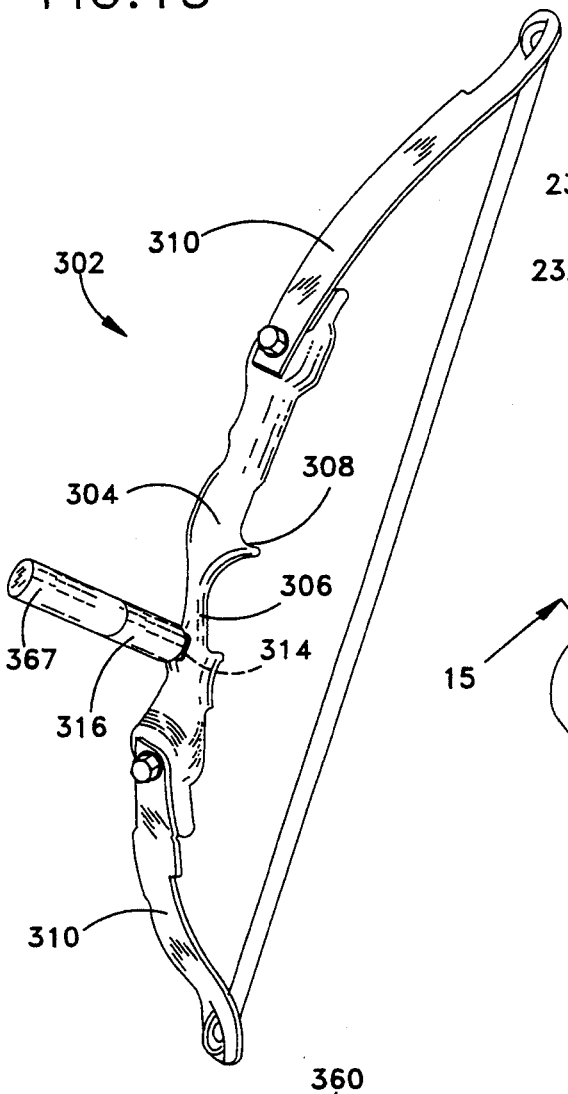
FIG.12
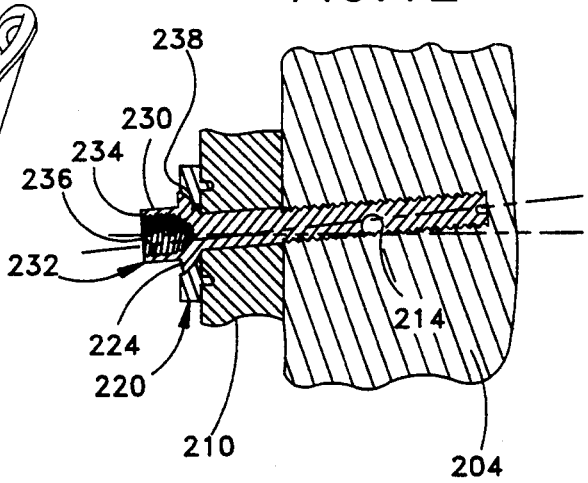
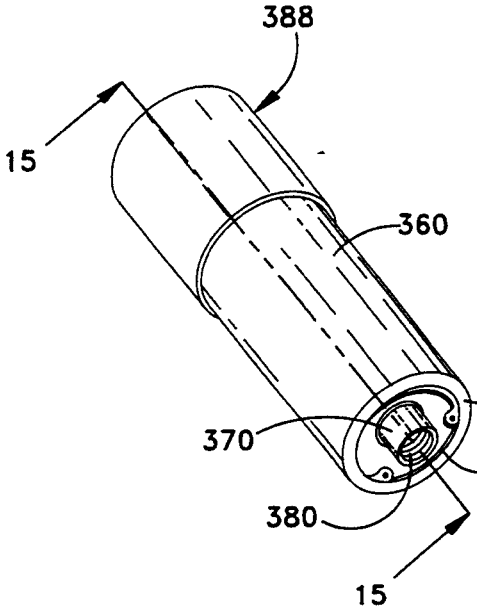
FIG.14
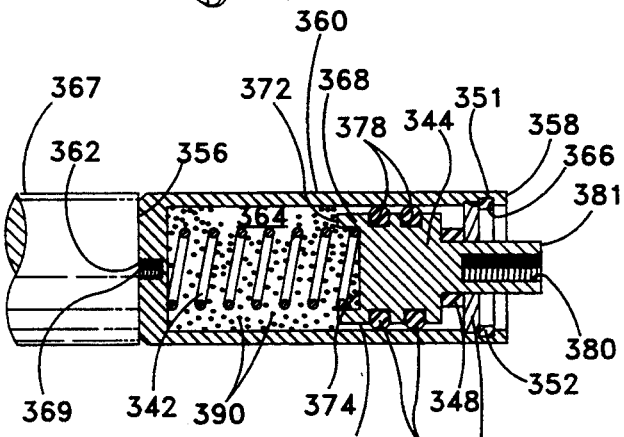
FIG.15
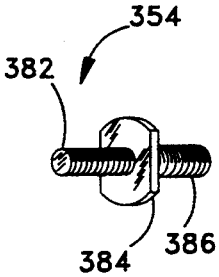
FIG.16

INDEXED SCALE FASTENER WITH DAMPING MEANS FOR USE IN CONJUNCTION WITH AN ARCHERY BOW

BACKGROUND OF THE INVENTION

1. Field of The Invention

The present invention generally relates to the field of archery bow accessories. In particular, the present invention apparatus is a combination of a damping means and an indexed scale fastener which can be adapted to each other or used separately to be attached to archery bows. The damping means is utilized for the purpose of absorbing vibrations, shock and noise that results when an arrow is released from the archery bow and to provide quieter, consistent and accurate shooting of the arrow from the archery bow. The indexed scale fastener is utilized for adjusting the poundage of archery bows.

2. Description of The Prior Art

A conventional archery bow has two hex screws and washers for tightening or loosening the poundage of the archery bow. The hex screws and washers are threadedly mounted into two identical threaded openings which are at the upper part of the archery bow limb and the lower part of the archery bow limb. The poundage needed depends on the distance of the target and the arrow being used. The more the hex screws are screwed into the archery bow, the tighter the bow and the more poundage there is. The hex screws and washers that are utilized in the prior an have no measuring means to measure the poundage on the archery bow. It is all done by guess work.

Damping devices for archery bows have been known in the prior art. In the archery bow which does not have a damping means thereon, there is a tendency for the archery bow to be longitudinally, laterally and rotationally displaced upon the release of the arrow from the archery bow. During this longitudinal, lateral and rotational displacement, the rigid handle portion of the archery bow moves in a vibrating manner in a direction away from the arrow as it passes past the archery bow handle.

There have been many different types of damping means utilized in the industry. One of the many disadvantages in the prior art damping means is that they only stabilize the archery bow in the lateral and rotational directions, but not the longitudinal direction. Another disadvantage is that they utilize resilient material which over a period of time can crack and fall. The properties of the rubber do not adequately solve the archer's needs in dampening the vibrations and reducing the noise when an arrow is released from the archery bow. A further disadvantage is that they are generally too long to be used for hunting. An additional disadvantage is that they utilize viscous fluid which over time can leak.

The following fourteen (14) prior art patents were uncovered in the pertinent field of the present invention.

1. U.S. Pat. No. 2,830,486 issued to Dillon on Apr. 15, 1958 for "Resilient Nut With Tension Indicating Means" (hereafter "the Dillon Patent").

2. U.S. Pat. No. 3,060,731 issued to Adise on Oct. 30, 1962 for "Motion Translator" (hereafter "the Adise Patent").

3. U.S. Pat. No. 3,602,186 issued to Popenoe on Aug. 31, 1971 for "Opti-Mechanical Stress-Strain Indicator" (hereafter "the Popenoe Patent").

4. U.S. Pat. No. 3,823,639 issued to Liber on Jul. 16, 1974 for "Tension Indicating Fastener" (hereafter "the Liber Patent").

5. U.S. Pat. No. 3,886,840 issued to Bossler on Jun. 3, 1975 for "Bolt Head Which Measures And Maintains Preload" (hereafter "the Bossler Patent").

6. U.S. Pat. No. 4,054,121 issued to Hoyt, Jr. on Oct. 18, 1977 for "Adjustable Mounting Means For Archery Bow Stabilizers" (hereafter "the Hoyt Patent").

7. U.S. Pat. No. 4,201,177 issued to Holman el al. on May 6, 1980 for "Compound Bow" (hereafter "the Holman Patent").

8. U.S. Pat. No. 4,201,182 issued to Butler on May 6, 1980 for "Compound Bow" (hereafter "the Butler Patent").

9. U.S. Pat. No. 4,615,327 issued to Saunders on Oct. 7, 1986 for "Resiliently Mounted Stabilizer" (hereafter "the Saunders Patent").

10. U.S. Pat. No. 4,779,602 issued to Hess, Sr. on Oct. 25, 1988 for "Archery Bow Shock Compensator" (hereafter "the Hess Patent").

11. U.S. Pat. No. 4,945,666 issued to Henry et al. on Aug. 7, 1990 for "Reactive Force Compensator For Projectile Firing Device" (hereafter "the Henry Patent").

12. U.S. Pat. No. 4,982,719 issued to Haggard et al. on Jan. 8, 1991 for "Hydraulic Bow Stabilizer" (hereafter "the Haggard Patent").

13. U.S. Pat. No. 5,016,602 issued to Mizek on May 21, 1991 for "Noise And Recoil Reducing Bow Stabilizer For Archery Bows" (hereafter "the Mizek Patent").

14. U.S. Pat. No. 5,165,831 issued to Yager et al. on Nov. 24, 1992 for "Capscrew Head Markings For Torque-Angle Tightening" (hereafter "the Yager Patent").

The Popenoe Patent discloses an opti-mechanical stress-strain indicator. It includes a bolt which has a large bore, and a pin disposed within the bore. The stress is measured by the color change of the fluid within the large bore.

The Bossler Patent discloses a bolt head which measures and maintains preload. An indicator-washer is mounted at the periphery of the upper recess, closing the recess and being relatively non-deflecting with respect to the ring, so that the relative position of the indicator pin and indicator-washer or ring is a function of the pre-load or load.

The Dillon Patent discloses a resilient nut with a tension indicating means. It includes a rectangular block having a vertical bore extending therethrough from top to bottom. An indicator is provided with one or more calibration lines positioned at any suitable point along the edge of the block for measuring the flexure.

The Adise Patent discloses a motion translator. An indicator card is carried by an arm at its free end. The card is provided with a uniformly graduated scale.

The Liber Patent discloses a tension indicating fastener. It is utilized to support mine shaft roofs.

The Holman Patent discloses a compound bow. The Holman device has two sets of double eccentric pulleys, cams, and wheels. They are contiguous and connected together but still separate and are movable with respect to each other. A miniature gear mechanism is provided for shifting them with respect to each other with a miniature allen wrench, and without disassembly of the parts.

The Yager Patent discloses a capscrew head marking for torque-angle tightening. It includes a fastener which has an externally threaded shank portion, a torque receiving portion integrally connected to one end of the shank portion and an outwardly extending flange located between the shank portion and the torque receiving portion.

The Saunders Patent discloses a resiliently mounted stabilizer. It is a two stage resiliently mounted stabilizer adapted to be attached to an archery bow. The first stage of the stabilizer has a first housing resiliently mounted to a pedestal by use of a flat resilient washer and a tubular resilient member within the housing. The second stage of the stabilizer includes a pair of tubular resilient members, one being disposed in a second housing. The resultant structure has the first and second housing vibrations dampened by the first washer and the first tubular member, and the vibrations of the second housing are not only dampened by that same structure, but further dampened by the resilient connection between the first housing and the second housing.

The Henry Patent discloses a reactive force compensator for projectile firing device. It includes an elongated casing adapted to permit the casing to be mounted on the projectile firing device with a length of the casing parallel to the direction of the force. A piston member is disposed in the casing and adapted to reciprocate while remaining parallel.

The Hess Patent discloses an archery bow shock compensator and balancer. It includes a central core that has a threaded stem at its trailing end. The threaded stem is received into a threaded socket conventionally provided in the forward face of an archery bow to secure the balancer-shock absorber. A hollow receptacle is threaded onto the forward end of the core to receive lead pellets or shot. When balancing, a threaded plug is removed from the receptacle and the pellets are poured into and precisely balance the core in the archer's hand so that there is no tendency for the bow to tilt from the vertical position.

The Haggard Patent discloses a hydraulic bow stabilizer which reduces the shock from firing a bow. It includes a piston movably received within a hydraulic cylinder.

The Mizek Patent discloses a noise and recoil reducing bow stabilizer for archery bows. The bow stabilizer has a hollow body which defines a chamber. An end plug is sealably secured to an end of the hollow body and another end plug is sealably secured to an opposite end of the hollow body. The bow stabilizer has at least one counterweight which is adjustable along a longitudinal axis of the hollow body to balance the archery bow. The chamber of the hollow body is partially filled with sterilized granular solids.

The Hoyt Patent discloses a device for mounting a pair of stabilizers for adjustable angular projection from opposite sides of a bow. It includes a transverse mounting bar attached to a face of the bow and extending from opposite sides. The inner bevelled faces of the adjustable members are provided with radial score lines of equal angular spacing. The mounting bar is provided with a scored index line. The angularly spaced lines may include indicia to indicate the angularly adjusted positions of the adjustable members in degrees.

The Butler Patent discloses a compound bow. Butler's device does not use a pulley mechanism, but employs pivot members which rotate less than a full turn from their position as the drawstring is fully released, to their position as the drawstring is fully drawn and the bow is cocked.

It can be seen that there is still a need for an improved indexed scale fastener that will facilitate the adjustment and measurement of the poundage on the archery bow and to have a new and improved damping means. It is desirable to eliminate the long guessing process of adjusting the poundage on the archery bow. It is also desirable to have a new and improved damping means which can be adapted to the indexed scale fastener or used separately by attachment to the archery bow.

SUMMARY OF THE INVENTION

The present invention apparatus is a novel and unique combination of a damping means adapted to an indexed scale fastener. The indexed scale fastener and the damping means can be used together or separately, where the damping member can be used at locations on the archery bow which are remote from the indexed scale fastener.

The concept is to have the indexed scale fastener adapted to the threaded openings where the prior art hex screws are located. A user can screw the indexed scale fastener to the archery bow and measure the poundage applied to the archery bow by simply reading the indexed scale provided on the indexed scale fastener. The damping member is to be threadedly mounted on top of the indexed scale fastener or to the archery bow, where threaded openings are provided in most commercially available archery bows. The damping member absorbs the vibrations in the longitudinal and lateral directions caused by releasing the arrow from the archery bow. The damping member also serves to dampen the sound of the archery bow and make the shooting of the arrow smoother.

It has been discovered, according to the present invention, that by utilizing an indexed scale fastener with a washer which has an indexed scale, it will provide a measuring means to accurately measure the poundage on the archery bow in a quick and efficient manner and without the time consuming process of prior art poundage measuring devices.

It has also been discovered, according to the present invention, that by utilizing the indexed scale fastener with an adaptable head portion, it will provide a means for attaching a damping means to the indexed scale fastener.

It has further been discovered, according to the present invention, that by utilizing a damping means which has an internal hollow chamber that is filled with a multiplicity of bird shot, it will provide a means for absorbing the vibrations, shock and noise from the archery bow.

It is therefore an object of the present invention to provide an apparatus which has a damping means which can be adapted to an indexed scale fastener. The damping means and the indexed scale fastener can also be utilized separately on the archery bow.

It is also an object of the present invention to provide an apparatus that is short in length and lightweight.

It is an additional object of the present invention to provide an indexed scale fastener with a washer which has an indexed scale, so that the indexed scale can be utilized to accurately measure the poundage on the archery bow in a quick and efficient manner, without the time consuming process of prior art poundage measuring devices.

It is a further object of the present invention to provide an indexed scale fastener with an adaptable head portion, so that a damping means can be threadedly mounted on the head portion of the indexed scale fastener.

It is an additional object of the present invention to provide a damping means which is filled with a multiplicity of bird shot, so that the multiplicity of bird shot can absorb the vibrations and shock in both the longitudinal and lateral directions and also dampen the noise from the archery bow.

Described generally, the present invention apparatus is a combination of a damping means adapted to an indexed scale fastener. The damping means comprises a cylindrical hollow housing with an interior chamber. The damping means also includes a spring means, two "O" rings, a C-clip, a keeper ring or washer and a threaded fastener which projects outwardly from the hollow housing for screwing into the indexed scale fastener or to the archery bow. The interior chamber has a multiplicity of #10 bird shot enclosed for absorbing the vibrations, shock and sound of the archery bow. The indexed scale fastener comprises an elongated threaded bolt and a washer. The washer has an indexed scale with a multiplicity of divisions for measuring the poundage on the archery bow. Also, additional weights can be attached to the damping means if desired.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 3 is a cross-sectional view taken along line 3—3 of FIG. 1.

FIG. 4 is a cross-sectional view taken along line 4—4 of FIG. 1.

FIG. 5 is an enlarged cross-sectional view of the circular flat washer.

FIG. 6 is a cross-sectional view of an alternative embodiment of the present invention apparatus.

FIG. 12 is a cross-sectional view of the indexed scale fastener, where the indexed scale fastener is tilted and still capable of mounting to the threaded opening on the archery bow.

FIG. 13 is a perspective view of another preferred embodiment of the present invention damping means, where the damping means is threadedly mounted to any conventional threaded opening on the archery bow.

FIG. 14 is a perspective view of the damping means.

FIG. 15 is a cross-sectional view taken along 15—15 of FIG. 14.

FIG. 16 is a perspective view of the threaded fastener.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The novelty of the present invention is that a user will now have a means to measure the poundage on a compound bow because of the indexed scale on the present invention, and a damping member for absorbing the vibrations, shock and noise that results when an arrow is released from the compound bow to provide quieter, consistent and accurate shooting of the arrow from the compound bow.

Figure 1:
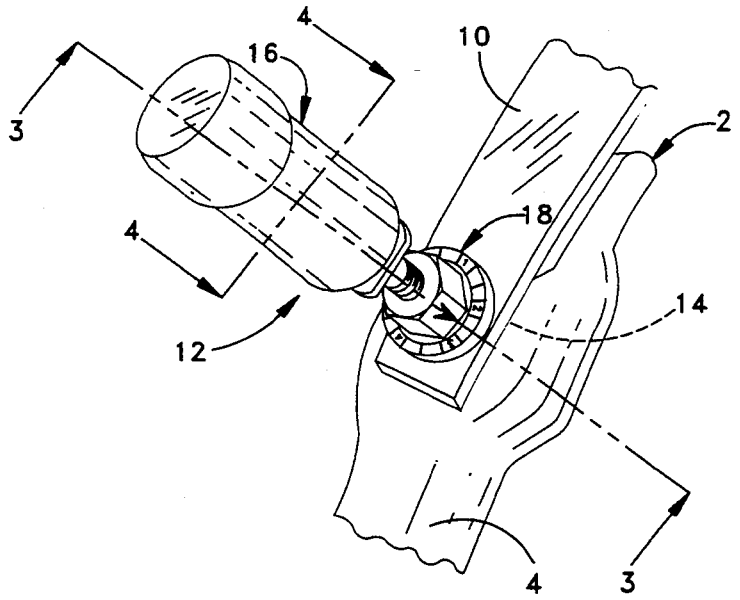
FIG. 1 is a perspective view of the preferred embodiment of the present invention apparatus which includes a damping means adapted to an indexed scale fastener, where an archery bow is partially shown, and the apparatus is threadedly mounted to either one of the two identical threaded openings which are on a conventional archery compound bow (as illustrated in FIG. 7).

Referring to FIG. 1, there is illustrated at 2 a partially shown conventional archery bow which is the type of a compound bow currently on the market and incorporating the present invention. The complete compound bow 2 will be only briefly described, since it is well-known to those skilled in the art. The compound bow 2 comprises a rigid handle 4 with a central grip, sight and two opposite flexible limbs. Only the upper limb 10 is shown in FIG. 1. The inner ends of the flexible limbs 10 are attached to the handle 4 by the present invention which is generally indicated by the reference numeral 12 for adjusting and measuring the poundage of the compound bow 2. The inner ends of the flexible limbs 10 and the handle 4 have two identical threaded openings 14 of which only one is shown. The present invention apparatus 12 can be threadedly mounted thereon and can be adapted to any conventional compound bow 2.

Figure 2:
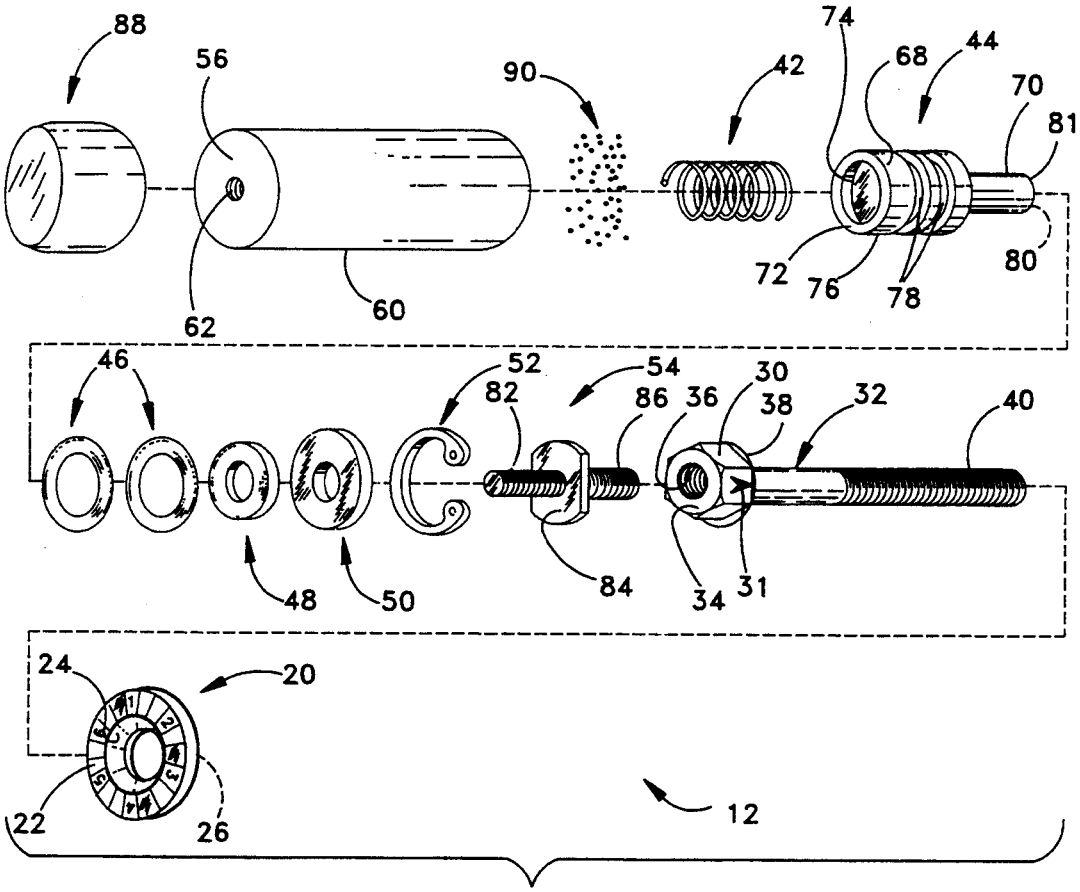
FIG. 2 is an exploded perspective view of the preferred embodiment of the present invention apparatus.

Referring to FIGS. 2 and 5, there is shown the apparatus 12 which includes a damping member or means 16 which can be adapted to an indexed scale fastener or bolt 18. The indexed scale fastener 18 includes a generally circular flat washer 20 and an elongated threaded bolt 32. The flat washer 20 has a top surface 22 with a dish shaped opening 24 therethrough and a rear surface 26 with two small pins 28 which project downwardly at opposite locations for keeping the flat washer 20 from rotating on the compound bow surface once the elongated threaded bolt 32 is threadedly mounted to the compound bow 2. The top surface 22 of the flat washer 20 has an indexed scale with a multiplicity of divisions for measuring the poundage of the compound bow 2. The indexed scale is utilized to facilitate the adjustment of the weight of the compound bow 2. The dimensions of the inside diameter d, the outside diameter D and the thickness T of the flat washer 20 are preferably 0.450 inch, 0.925 inch and 0.120 inch respectively. It will be appreciated that these dimensions described above are merely one illustrative embodiment and the washer 20 can include many other comparable sets of dimensions.

Referring to FIGS. 2 and 3, the elongated threaded bolt 32 has a head portion 30 and a shank portion 40 with external screw threads for threadedly engaging with either one of the two identical threaded openings 14 of the compound bow 2. The head portion 30 is configured as a hex nut which has a top 34 with a small central threaded aperture 36 and a half sphere shaped base 38. The dish shaped opening 24 of the flat washer 20 is to accommodate the half sphere shaped base 38 of the elongated threaded bolt 32. The head portion 30 has an identifying indicia 31 thereon for referencing with the indexed scale on the flat washer 20. If the elongated threaded bolt 32 is not screwed on correctly, the half sphere shaped base 38 will still properly engage with the dish shaped opening 24, even if the threaded bolt 32 is tilted, as shown in FIG. 12.

The poundage is based on the distance of the target and the arrow used. The poundage on the compound bow 2 is measured and adjusted by screwing in the elongated threaded bolt 32 into either one of the two identical threaded openings 14 of the compound bow 2. The more the elongated threaded bolt 32 is screwed into the compound bow 2, the tighter the compound bow 2 and the more poundage there is. By using the identifying indicia 31 for referencing with the indexed scale on the flat washer 20, the user knows how much poundage has been applied. To loosen the poundage on the compound bow 2, the user can reverse the procedure that was used for tightening the poundage on the compound bow 2.

Referring to FIGS. 2, 3 and 4, the damping member 16 includes a spring means 42, a piston member 44, two "O" rings 46, a cushioning pad 48, a keeper ring or flat washer 50, a "C" shaped retaining ring 52 and a threaded fastener 54. The damping member 16 has a cylindrical hollow housing with a top 56, a circumferential sidewall 60 and a base 58. The top 56 has an interior surface and an exterior surface with a small central threaded aperture 62 therein for receiving additional and optional weights, as best illustrated in FIGS. 13 and 15. These optional weights are utilized for balancing the compound bow 2 and have threaded stems thereon for being threadedly mounted within the central threaded aperture 62 of the damping member 16. The circumferential sidewall 60 has an interior surface which together with the interior surface of the top 56 defines an internal chamber 64. The circumferential sidewall 60 has an annular groove 66 which is located on the interior surface and adjacent to the base 58 of the damping member 16.

The piston member 44 is generally a cylindrical body which has an enlarged upper portion 68 and an elongated shank portion 70. The piston member 44 is disposed within the internal chamber 64 of the damping member 16 such that the elongated shank portion 70 projects outwardly from a large wide opening at the base 58. The enlarged upper portion 68 has a top end 72 with a recess 74 and a circumferential sidewall 76 with two spaced apart annular recesses 78. The elongated shank portion 70 has an internal threaded aperture 80 which is located adjacent to a bottom end 81 of the piston member 44. The threaded fastener 54 has an upper portion 82 with screw threads, a middle flange 84 and a lower portion 86 with screw threads. The middle flange 84 has an upper surface and a lower surface, where the upper portion 82 is threadedly mounted into the internal threaded aperture 80 of the elongated shaft portion 70 such that the upper surface of the middle flange 84 abuts against the bottom end 81 of the piston member 44. The lower portion 86 is threadedly mounted into the small central threaded aperture 36 at the top 34 of the elongated threaded bolt 32.

The two rubber "O" rings 46 are inserted respectively into the two spaced apart annular recesses 78 on the circumferential sidewall 76 of the piston member 44 for engaging with the interior surface of the circumferential sidewall 60 of the damping member 16. The "O" rings 46 seal the piston member 44 within the internal chamber 64 of the damping member 16.

The biasing spring means 42 is disposed within the chamber 64 and engages between the interior surface of the top 56 of the hollow housing and the recess 74 at the top end 72 of the piston member 44.

The rubber cushioning pad 48 is disposed between the enlarged upper portion 68 of the piston member 44 and the circular flat keeper ring 50 for cushioning the piston member 44 and permitting the rotation of the damping member 16 when in use. The C-shaped ring 52 is snapped in placed within the annular groove 66 on the circumferential sidewall 60 of the damping member 16 for securing the components within the internal chamber 64 of the damping member 16 and to keep them from falling out of the hollow housing. The keeper ring 50 is placed against a step portion 51 of the interior surface of the chamber 64 and retained in position by the C-shaped retaining ring 52. The internal chamber 64 of the hollow housing is filled with a multiplicity of #10 bird shot 90 for absorbing the vibrations, shock and noise from the compound bow 2.

The top 56 of the damping member 16 is covering by a plastic dust cap 88 which keeps dust out from the small threaded aperture 62.

In assembling the damping member 16, the biasing spring means 42 is disposed within the chamber 64. The chamber 64 is partially filled with the multiplicity of #10 bird shot 90 such that there is room for inserting the piston member 44 therein. The two rubber "O" rings 46 will seal and prevent the multiplicity of bird shot 90 from falling out of the chamber 64. The cushioning pad 48, the keeper ring 50 and the C-shaped ring 52 are disposed around the elongated shank portion 70 of the piston member 44, where the C-shaped ring 52 secures all of the components within the chamber 64. The threaded fastener 54 is threadedly mounted to the elongated shank portion 70 of the piston member 44 such that the damping member 16 can be threadedly mounted to the indexed scale fastener 18.

In operation, the flat washer 20 is aligned with either one of the two identical threaded openings 14 of the compound bow 2 such that the shank portion 40 of the elongated threaded bolt 32 is inserted through the dish shaped opening 24 of the flat washer 20, and thereby screwed into either one of the two identical threaded openings 14 of the compound bow 2. The damping member 16 is threadedly mounted to the top 34 of head portion 30 of the threaded bolt 32. The present invention apparatus 12 can now be used for measuring the poundage on the compound bow 2 by simply reading the indexed scale of the flat washer 20.

The damping member 16 can be constructed of any suitable lightweight or rigid material. By way of example, the damping member 16 can be constructed of a metal alloy, plastic, fiberglass, or the like. Preferably, the material used for the damping member 16 is one which does not corrode or deteriorate over time.

The present invention apparatus 12 can be manufactured with or without the compound bow 2. The damping member 16 can be utilized with or without the indexed scale fastener 18 by being threadedly mounted to the threaded openings 14 provided by any conventional archery bow.

Referring to FIG. 6, there is shown a cross-sectional view of an alternative embodiment of the present invention apparatus 112. Since it functions and assembles the same as previously described above, the parts are numbered correspondingly with 100 added to each reference number. The present invention 112 is substantially identical to the preferred embodiment, and to the extent they are, and since the piston member 144 is the only modified component, only the piston member 144 will be described in detail.

The piston member 144 is generally a cylindrical body which has an enlarged upper portion 168 and an elongated shank portion 170 with external screw threads. The piston member 144 is disposed within the internal chamber 164 of the damping member 116 such that the elongated shank portion 170 projects outwardly from a large wide opening at the base 158. The enlarged upper portion 168 has a top end 172 with a recess 174 and a circumferential sidewall 176 with two spaced apart annular recesses 178. The elongated shaft portion 170 of the piston member 144 is threadedly mounted into the small central threaded aperture 136 at the top 134 of the elongated threaded bolt 132. In this alternative embodiment, the threaded fastener 54 is eliminated from the present invention. The elongated shank portion 170 of the piston member 144 has external screw threads for threadedly engaging with the elongated threaded bolt 132.

Figure 7:
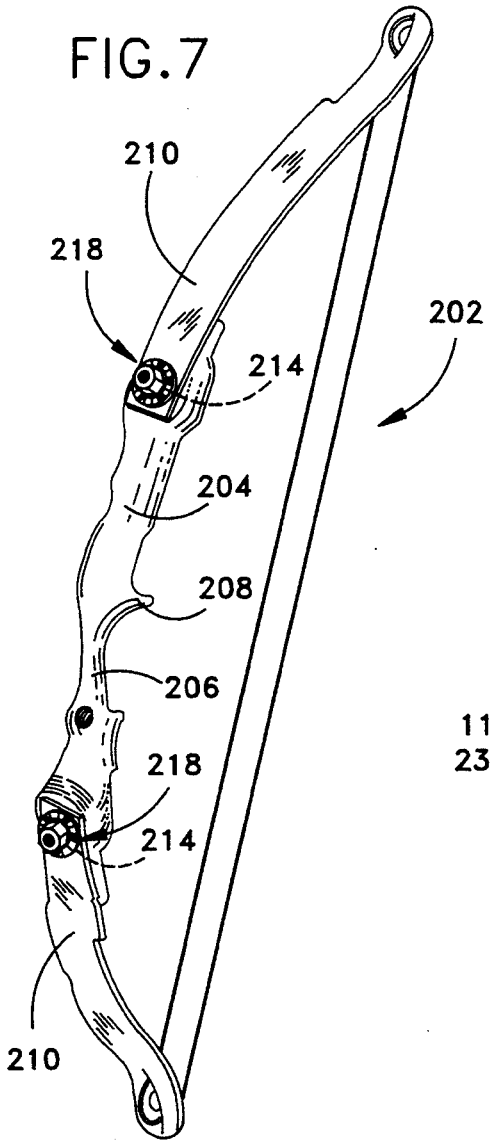
FIG. 7 is a perspective view of an another preferred embodiment of the present invention indexed scale fastener, where the indexed scale fastener can be threadedly mounted to an archery bow.
Figure 8:
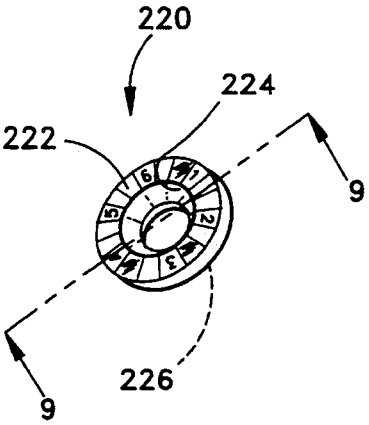
FIG. 8 is a perspective view of the circular flat washer.
Figure 9:
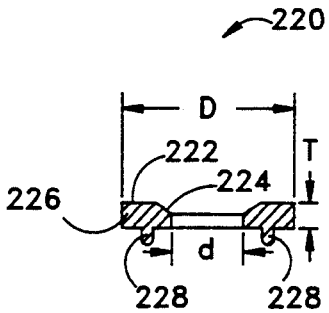
FIG. 9 is an enlarged cross-sectional view taken along 9—9 of FIG. 8.

Referring to FIG. 7, there is shown another preferred embodiment, where the indexed scale fastener 218 is utilized by itself. Since it is identical to the apparatus previously described above, the parts are numbered correspondingly with 200 added to each reference number.

There is shown at 202 a conventional archery bow which is the type of a compound bow currently on the market and incorporating the present invention indexed scale fastener 218. The complete compound bow 202 will be only briefly described, since it is well-known to those skilled in the art. The compound bow 202 comprises a rigid handle 204 with a central grip 206, sight 208 and opposite flexible limbs 210. The inner ends of the flexible limbs 210 are attached to the handle 204 by the present invention which is generally indicated by the reference numeral 218 for adjusting and measuring the poundage of the compound bow 202. The inner ends of the flexible limbs 210 and the handle 204 have two identical threaded openings 214 on the compound bow 202 in which the present invention indexed scale fastener 218 can be threadedly mounted thereon.

Referring to FIGS. 7, 8, 9 and 10, the indexed scale fastener 218 includes a generally circular flat washer 220 and an elongated threaded bolt 232. The flat washer 220 has a top surface 222 with a dish shaped opening 224 therethrough and a rear surface 226 with two small pins 228 which project downwardly at opposite locations for keeping the flat washer 220 from rotating on the compound bow surface once the elongated threaded bolt 232 is threadedly mounted to the compound bow 202. The top surface 222 of the flat washer 220 has an indexed scale with a multiplicity of divisions for measuring the poundage of the compound bow 202. The indexed scale is utilized to facilitate the adjustment of the weight of the compound bow 202. The dimensions of the inside diameter d, the outside diameter D and the thickness T of the flat washer 220 are preferably 0.450 inch, 0.925 inch and 0.120 inch respectively. It will be appreciated that these dimensions described above are merely one illustrative embodiment and the washer 220 can include many other comparable sets of dimensions.

Figure 10:
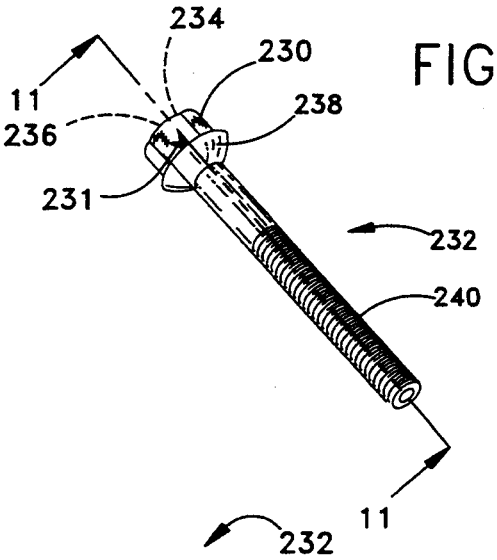
FIG. 10 is a perspective view of the elongated threaded bolt.
Figure 11:
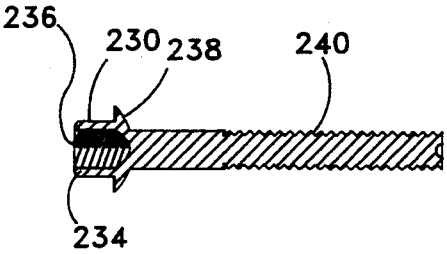
FIG. 11 is a cross-sectional view taken along 11—11 of FIG. 10.

Referring to FIGS. 10 and 11, the elongated threaded bolt 232 has a head portion 230 and a shank portion 240 with external screw threads for threadedly engaging with either one of the two identical threaded openings 214 of the compound bow 202. The head portion 230 is configured as a hex nut which has a top 234 with a small central threaded aperture 236 onto which a damping member (shown in FIG. 3) can be threadedly mounted. The dish shaped opening 224 of the flat washer 220 is to accommodate a half sphere shaped base 238 of the head portion 230 of the elongated threaded bolt 232. The head portion 230 has an identifying indicia 231 thereon for referencing with the indexed scale on the flat washer 220. If the elongated threaded bolt 232 is not screwed on correctly, the half sphere shaped base 238 will still properly engage with the dish shaped opening 224 even if the threaded bolt 232 is tilted, as shown in FIG. 12.

The poundage is based on the distance of the target and the arrow used. The poundage on the compound bow 202 is measured and adjusted by screwing in the elongated threaded bolt 232 into either one of the two identical threaded openings 21 4 of the compound bow 202. The more the elongated threaded bolt 232 is screwed into the compound bow 202, the tighter the compound bow 202 and the more poundage there is. By using the identifying indicia 231 for referencing with the indexed scale on the flat washer 220, the user knows how much poundage has been applied. To loosen the poundage on the compound bow 202, the user can reverse the procedure that was used for tightening the poundage on the compound bow 202.

Referring to FIGS. 7 through 12, in operation, the flat washer 220 is aligned with either one of the two identical threaded openings 214 of the compound bow 202 such that the shank portion 240 of the elongated threaded bolt 232 is inserted through the dish shaped opening 224 of the flat washer 220, and thereby screwed into either one of the two identical threaded openings 214 of the compound bow 202. The indexed scale fastener 218 can now be used for indicating the poundage on the compound bow 202 by simply reading the indexed scale of the flat washer 220.

The indexed scale fastener 218 can be manufactured with or without the compound bow 202. The indexed scale fastener 218 can be constructed of any suitable metal material. By way of example, the indexed scale fastener 218 can be constructed of a metal alloy which does not corrode or deteriorate over time.

Referring to FIG. 13, there is shown another preferred embodiment where a damping member 316 is utilized by itself. The damping member 316 can be attached to any conventional threaded opening provided on a compound bow 302 or recurve bow (not shown). Since it is identical to the apparatus previously described above, the parts are numbered correspondingly with 300 added to each reference number.

There is shown at 302 a conventional archery bow which is the type of a compound bow currently on the market and incorporating the damping member 316. The complete compound bow 302 will be only briefly described, since it is well-known to those skilled in the art. The compound bow 302 comprises a rigid handle 304 with a central grip 306, sight 308, a threaded opening 314 and opposite flexible limbs 310.

Referring to FIGS. 14, 15 and 16, there is shown another embodiment of the present invention damping member 316. The damping member 316 includes a spring means 342, a piston member 344, two "O" rings 346, a cushioning pad 348, a keeper ring or flat washer 350, a "C" shaped retaining ring 352 and a threaded fastener 354. The damping member 316 has a cylindrical hollow housing with a top 356, a circumferential sidewall 360 and a base 358. The top 356 has an interior surface and an exterior surface with a small central threaded aperture 362 therein for receiving additional and optional weights 367. These optional weights 367 are utilized for balancing the compound bow 302 and have threaded stems 369 thereon for being threadedly mounted within the central threaded aperture 362 of the damping member 316. The circumferential sidewall 360 has an interior surface which together with the interior surface of the top 356 defines an internal chamber 364. The circumferential sidewall 360 has an annular groove 366 which is located on the interior surface and adjacent to the base 358 of the damping member 316. The top 356 of the damping member 316 is covering by a plastic dust cap 388 which keeps dust out from the small threaded aperture 362.

The piston member 344 is generally a cylindrical body which has an enlarged upper portion 368 and an elongated shank portion 370. The piston member 344 is disposed within the internal chamber 364 of the damping member 316 such that the elongated shank portion 370 projects outwardly from a large wide opening at the base 358. The enlarged upper portion 368 has a top end 372 with a recess 374 and a circumferential sidewall 376 with two spaced apart annular recesses 378. The elongated shank portion 370 has an internal threaded aperture 380 which is located adjacent to a bottom end 381 of the piston member 344. The threaded fastener 354 has an upper portion 382 with screw threads, a middle flange 384 and a lower portion 386 with screw threads. The middle flange 384 has an upper surface and a lower surface, where the upper portion 382 is threadedly mounted into the internal threaded aperture 380 of the elongated shaft portion 370 such that the upper surface of the middle flange 384 abuts against the bottom end 381 of the piston member 344. The lower portion 386 is threadedly mounted into the threaded opening 314 on the compound bow 302 or to the small central threaded aperture at the top of the elongated threaded bolt, as shown in FIG. 3.

The two rubber "O" rings 346 are inserted respectively into the two spaced apart annular recesses 378 on the circumferential sidewall 376 of the piston member 344 for engaging with the interior surface of the circumferential sidewall 360 of the damping member 316. The "O" rings 346 seal the piston member 344 within the internal chamber 364 of the damping member 316.

The biasing spring means 342 is disposed within the interior chamber 364 of the damping member 316 and engages between the interior surface of the top 356 of the hollow housing and the recess 374 at the top end 372 of the piston member 344.

The rubber cushioning pad 348 is disposed between the enlarged upper portion 368 of the piston member 344 and the circular flat keeper ring 350 for cushioning the piston member 344 and permitting the rotation of the damping member 316 when in use. The C-shaped retaining ring 352 is snapped in placed within the annular groove 366 on the circumferential sidewall 360 of the damping member 316 for securing the components within the internal chamber 364 of the damping member 316 from falling out of the hollow housing. The keeper ring 350 is placed against a step portion 351 of the interior surface of the internal chamber 364 and retained in position by the C-shaped retaining ring 352. The internal chamber 364 of the hollow housing is filled with a multiplicity of #10 bird shot 390 for absorbing the vibrations, shock and noise from the compound bow 302.

In assembling the damping member 316, the biasing spring means 342 is disposed within the chamber 364. The chamber 364 is partially filled with the multiplicity of #10 bird shot 390 such that there is room for inserting the piston member 344 therein. The two rubber "O" rings 346 will seal and prevent the multiplicity of bird shot 390 from falling out of the chamber 364. The cushioning pad 348, the keeper ring 350 and the C-shaped ring 352 are disposed around the elongated shank portion 370 of the piston member 344, where the C-shaped ring 352 secures all of the components within the chamber 364. The threaded fastener 354 is threadedly mounted to the elongated shank portion 370 of the piston member 344 such that the damping member 316 can be threadedly mounted to any conventional threaded aperture on the compound bow 302 or recurve bow.

The damping member 316 can be constructed of any suitable lightweight or rigid material. By way of example, the damping member 316 can be constructed of a metal alloy, plastic, fiberglass, or the like. Preferably, the material used for the damping member 31 6 is one which does not corrode or deteriorate over time.

The piston member 344 can be manufactured with external screw threads on the elongated shank portion 370 such that the threaded fastener 354 is eliminated from the damping member 316. The elongated shank portion 370 of the piston member 344 will then threadedly engage with the compound bow 302.

Defined in detail, the present invention is an apparatus for a compound bow which has a threaded opening located at a limb of the compound bow, the apparatus threadedly mounted to the threaded opening for adjusting a poundage of the compound bow, and adsorbing vibrations and shock in both the longitudinal and lateral directions and damping the noise of the compound bow caused by the release of an arrow, the apparatus comprising: (a) a generally flat circular washer having a top surface with a dish shaped opening therethrough and a rear surface with two small pins projecting downwardly at opposite locations for keeping the flat washer from rotating on said compound bow; (b) said top surface of said flat washer having an indexed scale with a multiplicity of divisions for indicating said poundage on said compound bow; (c) an elongated threaded bolt having a head portion and a shank portion with external screw threads for threadedly engaging with said threaded opening of said compound bow, the head portion of the elongated threaded bolt configured as a hex nut and having a top with a small central threaded aperture and a half sphere shaped base for engaging closely with said dish shaped opening of said flat washer, the elongated threaded bolt having an identifying indicia thereon for referencing with said indexed scale on said flat washer; (d) a damping member having a generally cylindrical hollow housing with a top, a circumferential sidewall and a base with a large wide opening, the top having an exterior surface with a small central threaded aperture and an interior surface, the circumferential sidewall having an interior surface which together with the interior surface of the top defines an internal chamber; (e) an annular groove located on said interior surface of said circumferential sidewall of said hollow housing adjacent to said base of said hollow housing; (f) a generally cylindrical piston member having an enlarged upper portion and an elongated shank portion, the piston member disposed within said internal chamber of said damping member such that the elongated shank portion projects outwardly from said large wide opening of said base, the enlarged upper portion having a top end with a recess and a circumferential sidewall with two spaced apart annular recesses, the elongated shank portion having an internal threaded aperture adjacent to a bottom end of the piston member; (g) a threaded fastener having an upper portion with screw threads, a middle flange and a lower portion with screw threads, the middle flange having an upper surface and a lower surface, where the upper portion is threadedly screwed into said internal threaded aperture of said elongated shank portion such that the upper surface of said middle flange abuts against said bottom end of said piston member, and the lower portion threadedly screwed into said small central threaded aperture at said top of said elongated threaded bolt; (h) two "O" rings inserted respectively into said two spaced apart annular recesses of said circumferential sidewall of said piston member for engaging with said interior surface of said circumferential sidewall of said damping member; (i) a biasing spring disposed within said interior chamber of said damping member and engaged between said interior surface of said top of said hollow housing and said recess at said top end of said piston member; (j) a cushioning pad disposed on said elongated shank of said piston member for cushioning said piston member; (k) a generally flat keeper ring disposed on said elongated shank portion of said piston member and engaged with a stepped portion of said interior surface of said circumferential sidewall of said damping member for securing and permitting rotation of said damping member; (l) a C-shaped retaining ring placed within said annular groove of said interior surface of said circumferential sidewall of said damping member for further securing said keeper ring and said piston member within said internal chamber of said damping member; and (m) a multiplicity of bird shot filled within said internal chamber of said damping member for absorbing the vibrations, shock and noise from said compound bow; (n) whereby when said flat washer is placed around said threaded opening of said compound bow, and said elongated threaded bolt is screwed into said threaded opening of said compound bow such that said half sphere shaped base is engaged with said dish shaped opening, said poundage of said compound bow can easily be adjusted by reading said indexed scale on said flat washer, and said damping member can be threadedly mounted to said small central threaded aperture on said top of said head portion of said elongated threaded bolt for absorbing said vibrations and said shock in the longitudinal and lateral directions and also for damping said noise from said compound bow.

Also defined in detail, the present invention is an apparatus for a compound bow which has threaded opening located at a limb of the compound bow, the apparatus threadedly mounted to the threaded opening for adjusting a poundage of the compound bow, and adsorbing vibrations and shock in both the longitudinal and lateral directions and damping the noise of the compound bow caused by the release of an arrow, the apparatus comprising: (a) a generally flat circular washer having a top surface with a dish shaped opening therethrough and a rear surface with two small pins projecting downwardly at opposite locations for keeping the flat washer from rotating on said compound bow; (b) said top surface of said flat washer having an indexed scale with a multiplicity of divisions for indicating said poundage of said compound bow; (c) an elongated threaded bolt having a head portion and a shank portion with external screw threads for threadedly engaging with said threaded opening of said compound bow, the head portion of the elongated threaded bolt configured as a hex nut and having a top with a small central threaded aperture and a half sphere shaped base for engaging closely within said dish shaped opening of said flat washer, the elongated threaded bolt having an identifying indicia thereon for referencing with said indexed scale on said flat washer; (d) a damping member having a generally cylindrical hollow housing with a top, a circumferential sidewall and a base with a large wide opening, the top having an exterior surface with a small central threaded aperture and an interior surface, the circumferential sidewall having an interior surface which together with the interior surface of the top defines an internal chamber; (e) an annular groove located on said interior surface of said circumferential sidewall of said hollow housing adjacent to said base of said hollow housing; (f) a generally cylindrical piston member having an enlarged upper portion and an elongated shank portion with external screw threads, the piston member disposed within said internal chamber of said damping member such that the elongated shank portion projects outwardly from said large wide opening of said base, the enlarged upper portion having a top end with a recess and a circumferential sidewall with two spaced apart annular recesses; (g) two "O" rings inserted respectively into said two spaced apart annular recesses of said circumferential sidewall of said piston member for engaging with said interior surface of said circumferential sidewall of said damping member; (h) a biasing spring disposed within said interior chamber of said damping member and engaged between said interior surface of said top of said hollow housing and said recess at said top end of said piston member; (i) a cushioning pad disposed on said elongated shank of said piston member for cushioning said piston member; (j) a generally flat keeper ring disposed on said elongated shank portion of said piston member and engaged with a stepped portion of said interior surface of said circumferential sidewall of said damping member for securing and permitting rotation of said damping member; (k) a C-shaped retaining ring placed within said annular groove of said interior surface of said circumferential sidewall of said damping member for further securing said keeper ring and said piston member within said internal chamber of said damping member; and (l) a multiplicity of bird shot filled within said internal chamber of said damping member for absorbing the vibrations, shock and noise from said compound bow; (m) whereby when said flat washer is placed around said threaded opening of said compound bow, and said elongated threaded bolt is screwed into said threaded opening of said compound bow such that said half sphere shaped base is engaged with said dish shaped opening, said poundage of said compound bow can easily be adjusted by reading said indexed scale on said flat washer, and said damping member can be threadedly mounted into said small central threaded aperture on said top of said head portion of said elongated threaded bolt for absorbing said vibrations and said shock in the longitudinal and lateral directions and also dampens said noise from said compound bow.

Defined broadly, the present invention is an apparatus for an archery bow having a threaded opening, comprising: (a) a washer having a top surface with an indexed scale and a concave cavity; (b) a bolt having a nut portion and a shank portion with screw threads for threadedly engaging into said threaded opening of said archery bow, the nut portion having a top with a threaded aperture and a convex base for mating with said concave cavity of said washer; (c) a damping means having a top, a sidewall and a base with an opening, the top having an exterior surface with a threaded aperture and an interior surface, the sidewall having an interior surface which together with the interior surface of the top defines a hollow chamber, the interior surface of the sidewall having an annular groove; (d) a piston means having an upper portion and a shank portion, the upper portion having a top end and a sidewall; (e) means for connecting said shank portion of said piston means to said bolt; (f) means for engaging between said top of said damping means and said piston means; (g) means for cushioning said piston means; (h) means for securing said piston means within said hollow chamber of said damping means; and (i) means for absorbing the vibrations, shock and noise from said archery bow; (j) whereby when said washer is placed on said archery bow, and said bolt is screwed into said archery bow such that said convex base of said bolt is engaged with said concave cavity of said washer and a poundage of said archery bow can easily be adjusted by reading said indexed scale on said washer, and thereby said damping means absorbs said vibrations and said shock in the longitudinal and lateral directions and damping said noise from said archery bow.

Also defined in detail, the present invention is an index scale fastener for a compound bow which has a threaded opening located at a limb of the compound bow, the apparatus threadedly mounted to the threaded opening for adjusting a poundage of the compound bow, the apparatus comprising: (a) a generally flat circular washer having a top surface with a dish shaped opening therethrough and a rear surface with two small pins projecting downwardly at opposite locations for keeping the flat washer from rotating on said compound bow; (b) said top surface of said flat washer having an indexed scale with a multiplicity of divisions for indicating said poundage on said compound bow; and (c) an elongated threaded bolt having a head portion and a shank portion with external screw threads for threadedly engaging with said threaded opening of said compound bow, the head portion of the elongated threaded bolt configured as a hex nut and having a top with a small central threaded aperture and a half sphere shaped base for engaging closely within said dish shaped opening of said flat washer, the elongated threaded bolt having an identifying indicia thereon for referencing with said indexed scale on said flat washer; (d) whereby when said flat washer is placed around said threaded opening of said compound bow, and said elongated threaded bolt is screwed into said threaded opening of said compound bow such that said half sphere shaped base is engaged with said dish shaped opening, said poundage of said compound bow can easily be adjusted by reading said indexed scale on said flat washer.

Also defined broadly, the present invention is an indexed bolt for an archery bow having a threaded opening, comprising: (a) a washer having a top surface with a scale, a rear surface and a concave cavity; and (b) a bolt having a nut portion and a shank portion with screw threads for threadedly engaging into said threaded opening of said archery bow, the nut portion having a convex base which mates with said concave cavity of said washer and means for indicating with said scale on said washer; (c) whereby when said washer is placed on said archery bow, and said bolt is screwed into said archery bow such that said convex base of said bolt is engaged with said concave cavity of said washer, the poundage on said archery bow can be adjusted by reading said scale on said washer.

Further defined in detail, the present invention is a damping member for attachment to a compound bow which has a threaded opening, the damping member used for adsorbing vibrations and shock in both the longitudinal and lateral directions and damping the noise of the compound bow caused by the release of an arrow, the damping member comprising: (a) a generally cylindrical hollow housing having a top, a circumferential sidewall and a base with a large wide opening, the top having an exterior surface with a small central threaded aperture and an interior surface, the circumferential sidewall having an interior surface which together with the interior surface of the top defines an internal chamber; (b) an annular groove located on said interior surface of said circumferential sidewall of said hollow housing adjacent to said base of said hollow housing; (c) a generally cylindrical piston member having an enlarged upper portion and an elongated shank portion, the piston member disposed within said internal chamber of said hollow housing such that the elongated shank portion projects outwardly from said large wide opening of said base, the enlarged upper portion having a top end with a 16 recess and a circumferential sidewall with two spaced apart annular recesses, the elongated shank portion having an internal threaded aperture adjacent to a bottom end of the piston member; (d) a threaded fastener having an upper portion with screw threads, a middle flange and a lower portion with screw threads, the middle flange having an upper surface and a lower surface, where the upper portion is threadedly screwed into said internal threaded aperture of said elongated shank portion such that the upper surface of said middle flange abuts against said bottom end of said piston member; (e) two "O" rings inserted respectively into said two spaced apart annular recesses of said circumferential sidewall of said piston member for engaging with said interior surface of said circumferential sidewall of said hollow housing; (f) a biasing spring disposed within said interior chamber said hollow housing and engaged between said interior surface of said top of said hollow housing and said recess at said top end of said piston member; (g) a cushioning pad disposed on said elongated shank of said piston member for cushioning said piston member; (h) a generally flat keeper ring disposed on said elongated shank portion of said piston member and engaged with a stepped portion of said interior surface of said circumferential sidewall of said hollow housing for securing and permitting rotation of said hollow housing; (i) a C-shaped retaining ring placed within said annular groove of said interior surface of said circumferential sidewall of said hollow housing for further securing said keeper ring and said piston member within said internal chamber of said hollow housing; and (j) a multiplicity of bird shot filled within said internal chamber of said hollow housing for absorbing the vibrations, shock and noise from said compound bow; (k) whereby said lower portion of said threaded fastener is screwed into said threaded opening of said compound bow, and thereby said damping member absorbs said vibrations and said shock in the longitudinal and lateral directions and damping said noise from said compound bow.

Further defined broadly, the present invention is a damping means for attachment to a compound bow which has a threaded opening, the damping means used for adsorbing vibrations and shock in both the longitudinal and lateral directions and damping the noise of the compound bow caused by the release of an arrow, the damping means comprising: (a) a generally cylindrical hollow housing having a top, a circumferential sidewall and a base with a large wide opening, the top having an exterior surface with a small central threaded aperture and an interior surface, the circumferential sidewall having an interior surface which together with the interior surface of the top defines an internal chamber; (b) an annular groove located on said interior surface of said circumferential sidewall of said hollow housing adjacent to said base of said hollow housing; (c) a generally cylindrical piston member having an enlarged upper portion and an elongated shank portion with external screw threads, the piston member disposed within said internal chamber of said hollow housing such that the elongated shank portion projects outwardly from said large wide opening of said base, the enlarged upper portion having a top end with a recess and a circumferential sidewall with two spaced apart annular recesses; (d) two "O" rings inserted respectively into said two spaced apart annular recesses of said circumferential sidewall of said piston member for engaging with said interior surface of said circumferential sidewall of said hollow housing; (e) a biasing spring disposed within said interior chamber of said hollow housing and engaged between said interior surface of said top of said hollow housing and said recess at said top end of said piston member; (f) a cushioning pad disposed on said elongated shank of said piston member for cushioning said piston member; (g) a generally flat keeper ring disposed on said elongated shank portion of said piston member and engaged with a stepped portion of said interior surface of said circumferential sidewall of said hollow housing for securing and permitting rotation of said hollow housing; (h) a C-shaped retaining ring placed within said annular groove of said interior surface of said circumferential sidewall of said hollow housing for further securing said keeper ring and said piston member within said internal chamber of said hollow housing; and (i) a multiplicity of bird shot filled within said internal chamber of said hollow housing for absorbing the vibrations, shock and noise from said compound bow; (j) whereby said elongated shank portion of said piston member is screwed into said threaded opening of said compound bow, and thereby said damping member absorbs said vibrations and said shock in the longitudinal and lateral directions and damping said noise from said compound bow.

Further defined more broadly, the present invention is a damping means for an archery bow having a threaded opening, comprising: (a) a housing having a top, a sidewall and a base with an opening, the top having an exterior surface with a threaded aperture and an interior surface, the sidewall having an interior surface which together with the interior surface of the top defines a hollow chamber, the interior surface of the sidewall having an annular groove; (b) a piston means having an upper portion and a shank portion, the upper portion having a top end and a sidewall; (c) means for connecting said shank portion of said piston means to said archery bow; (d) means for engaging between said top of said housing and said top end of said piston means; (e) means for cushioning said piston means; (f) means for securing said piston means within said hollow chamber of said housing; and (g) means for absorbing the vibrations, shock and noise from said archery bow; (h) whereby said damping means is screwed into said archery bow, and thereby said damping means absorbs said vibrations and said shock in the longitudinal and lateral directions and damping said noise from said archery bow.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An apparatus for a compound bow which has a threaded opening located at a limb of the compound bow, the apparatus threadedly mounted to the threaded opening for adjusting a poundage of the compound bow, and adsorbing vibrations and shock in both the longitudinal and lateral directions and damping the noise of the compound bow caused by the release of an arrow, the apparatus comprising:

a. a generally flat circular washer having a top surface with a dish shaped opening therethrough and a rear surface with two small pins projecting downwardly at opposite locations for keeping the flat washer from rotating on said compound bow;

b. said top surface of said flat washer having an indexed scale with a multiplicity of divisions for indicating said poundage on said compound bow;

c. an elongated threaded bolt having a head portion and a shank portion with external screw threads for threadedly engaging with said threaded opening of said compound bow, the head portion of the elongated threaded bolt configured as a hex nut and having a top with a small central threaded aperture and a half sphere shaped base for engaging closely with said dish shaped opening of said flat washer, the elongated threaded bolt having an identifying indicia thereon for referencing with said indexed scale on said flat washer;

d. a damping member having a generally cylindrical hollow housing with a top, a circumferential sidewall and a base with a large wide opening, the top having an exterior surface with a small central threaded aperture and an interior surface, the circumferential sidewall having an interior surface which together with the interior surface of the top defines an internal chamber;

e. an annular groove located on said interior surface of said circumferential sidewall of said hollow housing adjacent to said base of said hollow housing;

f. a generally cylindrical piston member having an enlarged upper portion and an elongated shank portion, the piston member disposed within said internal chamber of said damping member such that the elongated shank portion projects outwardly from said large wide opening of said base, the enlarged upper portion having a top end with a recess and a circumferential sidewall with two spaced apart annular recesses, the elongated shank portion having an internal threaded aperture adjacent to a bottom end of the piston member;

g. a threaded fastener having an upper portion with screw threads, a middle flange and a lower portion with screw threads, the middle flange having an upper surface and a lower surface, where the upper portion is threadedly screwed into said internal threaded aperture of said elongated shank portion such that the upper surface of said middle flange abuts against said bottom end of said piston member, and the lower portion threadedly screwed into said small central threaded aperture at said top of said elongated threaded bolt;

h. two "O" rings inserted respectively into said two spaced apart annular recesses of said circumferential sidewall of said piston member for engaging with said interior surface of said circumferential sidewall of said damping member;

i. a biasing spring disposed within said interior chamber of said damping member and engaged between said interior surface of said top of said hollow housing and said recess at said top end of said piston member;

j. a cushioning pad disposed on said elongated shank of said piston member for cushioning said piston member;

k. a generally flat keeper ring disposed on said elongated shank portion of said piston member and engaged with a stepped portion of said interior surface of said circumferential sidewall of said damping member for securing and permitting rotation of said damping member;

l. a C-shaped retaining ring placed within said annular groove of said interior surface of said circumferential sidewall of said damping member for further securing said keeper ring and said piston member within said internal chamber of said damping member; and m. a multiplicity of bird shot filled within said internal chamber of said damping member for absorbing the vibrations, shock and noise from said compound bow;

n. whereby when said flat washer is placed around said threaded opening of said compound bow, and said elongated threaded bolt is screwed into said threaded opening of said compound bow such that said half sphere shaped base is engaged with said dish shaped opening, said poundage of said compound bow can easily be adjusted by reading said indexed scale on said flat washer, and said damping member can be threadedly mounted to said small central threaded aperture on said top of said head portion of said elongated threaded bolt for absorbing said vibrations and said shock in the longitudinal and lateral directions and also for damping said noise from said compound bow.

2. The invention as defined in claim 1 further comprising a plastic cap for covering said damping member.

3. The invention as defined in claim 1 wherein said multiplicity of bird shot is #10 bird shot.

4. The invention as defined in claim 1 wherein additional weight can be added to said apparatus by screwing the weight into said small central threaded aperture at said top of said damping member.

5. The invention as defined in claim 1 wherein said two "O" rings and said cushioning pad are made of rubber material.

6. An apparatus for a compound bow which has threaded opening located at a limb of the compound bow, the apparatus threadedly mounted to the threaded opening for adjusting a poundage of the compound bow, and adsorbing vibrations and shock in both the longitudinal and lateral directions and damping the noise of the compound bow caused by the release of an arrow, the apparatus comprising:

a. a generally flat circular washer having a top surface with a dish shaped opening therethrough and a rear surface with two small pins projecting downwardly at opposite locations for keeping the flat washer from rotating on said compound bow;

b. said top surface of said flat washer having an indexed scale with a multiplicity of divisions for indicating said poundage of said compound bow;

c. an elongated threaded bolt having a head portion and a shank portion with external screw threads for threadedly engaging with said threaded opening of said compound bow, the head portion of the elongated threaded bolt configured as a hex nut and having a top with a small central threaded aperture and a half sphere shaped base for engaging closely within said dish shaped opening of said flat washer, the elongated threaded bolt having an identifying indicia thereon for referencing with said indexed scale on said flat washer;

d. a damping member having a generally cylindrical hollow housing with a top, a circumferential sidewall and a base with a large wide opening, the top having an exterior surface with a small central threaded aperture and an interior surface, the circumferential sidewall having an interior surface which together with the interior surface of the top defines an internal chamber;

e. an annular groove located on said interior surface of said circumferential sidewall of said hollow housing adjacent to said base of said hollow housing;

f. a generally cylindrical piston member having an enlarged upper portion and an elongated shank portion with external screw threads, the piston member disposed within said internal chamber of said damping member such that the elongated shank portion projects outwardly from said, large wide opening of said base, the enlarged upper portion having a top end with a recess and a, circumferential sidewall with two spaced apart annular recesses;

g. two "O" rings inserted respectively into said two spaced apart annular recesses of said circumferential sidewall of said piston member for engaging with said interior surface of said circumferential sidewall of said damping member;

h. a biasing spring disposed within said interior chamber of said damping member and engaged between said interior surface of said top of said hollow housing and said recess at said top end of said piston member;

i. a cushioning pad disposed on said elongated shank of said piston member for cushioning said piston member;

j. a generally flat keeper ring disposed on said elongated shank portion of said piston member and engaged with a stepped portion of said interior surface of said circumferential sidewall of said damping member for securing and permitting rotation of said damping member;

k. a C-shaped retaining ring placed within said annular groove of said interior surface of said circumferential sidewall of said damping member for further securing said keeper ring and said piston member within said internal chamber of said damping member; and l. a multiplicity of bird shot filled within said internal chamber of said damping member for absorbing the vibrations, shock and noise from said compound bow;

m. whereby when said flat washer is placed around said threaded opening of said compound bow, and said elongated threaded bolt is screwed into said threaded opening of said compound bow such that said half sphere shaped base is engaged with said dish shaped opening, said poundage of said compound bow can easily be adjusted by reading said indexed scale on said flat washer, and said damping member can be threadedly mounted into said small central threaded aperture on said top of said head portion of said elongated threaded bolt for absorbing said vibrations and said shock in the longitudinal and lateral directions and also dampens said noise from said compound bow.

7. The invention as defined in claim 6 further comprising a plastic cap for covering said damping member.

8. The invention as defined in claim 6 wherein said multiplicity of bird shot is #10 bird shot.

9. The invention as defined in claim 6 wherein additional weight can be added to said apparatus by screwing the weight into said small central threaded aperture at said top of said damping member.

10. The invention as defined in claim 6 wherein said two "O" rings and said cushioning pad are made of rubber material.

11. An apparatus for an archery bow having a threaded opening, comprising:

a. a washer having a top surface with an indexed scale and a concave cavity;

b. a bolt having a nut portion and a shank portion with screw threads for threadedly engaging into said threaded opening of said archery bow, the nut portion having a top with a threaded aperture and a convex base for mating with said concave cavity of said washer;

c. a damping means having a top, a sidewall and a base with an opening, the top having an exterior surface with a threaded aperture and an interior surface, the sidewall having an interior surface which together with the interior surface of the top defines a hollow chamber, the interior surface of the sidewall having an annular groove;

d. a piston means having an upper portion and a shank portion, the upper portion having a top end and a sidewall;

e. means for connecting said shank portion of said piston means to said bolt;

f. means for engaging between said top of said damping means and said piston means;

g. means for cushioning said piston means;

h. means for securing said piston means within said hollow chamber of said damping means; and i. means for absorbing the vibrations, shock and noise from said archery bow;

j. whereby when said washer is placed on said archery bow, and said bolt is screwed into said archery bow such that said convex base of said bolt is engaged with said concave cavity of said washer and a poundage of said archery bow can easily be adjusted by reading said indexed scale on said washer, and thereby said damping means absorbs said vibrations and said shock in the longitudinal and lateral directions and damping said noise from said archery bow.

12. The invention as defined in claim 11 further comprising a plastic cap for covering said damping means.

13. The invention as defined in claim 11 wherein said nut portion of said bolt includes an identifying indicia thereon for referencing with said indexed scale on said washer.

14. The invention as defined in claim 11 wherein said means for connecting said piston means to said bolt includes a threaded fastener which has an upper portion with screw threads and a lower portion with screw threads, where the upper portion is threadedly screwed into said shank portion of said piston means and the lower portion is threadedly screwed into said threaded aperture at said top of said nut portion of said bolt.

15. The invention as defined in claim 11 wherein said means for connecting said piston means to said bolt includes external screw threads on said shank portion of said piston means such that said shank portion is threadedly screwed into said threaded aperture at said top of said nut portion of said bolt.

16. The invention as defined in claim 11 wherein said means for engaging between said top of said damping means and said piston means includes a biasing spring.

17. The invention as defined in claim 11 wherein said means for cushioning said piston means includes a rubber cushioning pad.

18. The invention as defined in claim 11 wherein said means for securing said piston means within said hollow chamber of said damping means includes a keeper ring and a C-shaped retaining ring, where both are placed on said shank portion of said piston means respectively and the C-shaped retaining ring is inserted into said annular groove of said interior surface of said sidewall.

19. The invention as defined in claim 11 wherein said means for absorbing said vibrations, shock and noise from said archery bow includes a multiplicity of bird shot which are filled within said hollow chamber of said damping means.

20. The invention as defined in claim 11 wherein said multiplicity of bird shot is #10 bird shot.

21. An index scale fastener for a compound bow which has a threaded opening located at a limb of the compound bow, the apparatus threadedly mounted to the threaded opening for adjusting a poundage of the compound bow, the apparatus comprising:

a. a generally flat circular washer having a top surface with a dish shaped opening therethrough and a rear surface with two small pins projecting downwardly at opposite locations for keeping the flat washer from rotating on said compound bow;

b. said top surface of said flat washer having an indexed scale with a multiplicity of divisions for indicating said poundage on said compound bow; and c. an elongated threaded bolt having a head portion and a shank portion with external screw threads for threadedly engaging with said threaded opening of said compound bow, the head portion of the elongated threaded bolt configured as a hex nut and having a top with a small central threaded aperture and a half sphere shaped base for engaging closely within said dish shaped opening of said flat washer, the elongated threaded bolt having an identifying indicia thereon for referencing with said indexed scale on said flat washer;

d. whereby when said flat washer is placed around said threaded opening of said compound bow, and said elongated threaded bolt is screwed into said threaded opening of said compound bow such that said half sphere shaped base is engaged with said dish shaped opening, said poundage of said compound bow can easily be adjusted by reading said indexed scale on said flat washer.

22. The invention as defined in claim 21 wherein said small central threaded aperture of said elongated threaded bolt can be utilized for mounting a damping means.

23. An indexed bolt for an archery bow having a threaded opening, comprising:

a. a washer having a top surface with a scale, a rear surface and a concave cavity, the rear surface having two small pins which project downwardly for keeping the washer from moving on said archery bow; and b. a bolt having a nut portion and a shank portion with screw threads for threadedly engaging into said threaded opening of said archery bow, the nut portion having a convex base which mates with said concave cavity of said washer and means for indicating with said scale on said washer;

c. whereby when said washer is placed on said archery bow, and said bolt is screwed into said archery bow such that said convex base of said bolt is engaged with said concave cavity of said washer, the poundage on said archery bow can be adjusted by reading said scale on said washer.

24. The invention as defined in claim 23 wherein said nut portion of said bolt has a generally hex nut shape.

25. The invention as defined in claim 23 wherein said nut portion of said bolt has a top with a threaded aperture such that a damping means can be threadedly mounted therein.

26. A damping member for attachment to a compound bow which has a threaded opening, the damping member used for adsorbing vibrations and shock in both the longitudinal and lateral directions and damping the noise of the compound bow caused by the release of an arrow, the damping member comprising:

a. a generally cylindrical hollow housing having a top, a circumferential sidewall and a base with a large wide opening, the top having an exterior surface with a small central threaded aperture and an interior surface, the circumferential sidewall having an interior surface which together with the interior surface of the top defines an internal chamber;

b. an annular groove located on said interior surface of said circumferential sidewall of said hollow housing adjacent to said base of said hollow housing;

c. a generally cylindrical piston member having an enlarged upper portion and an elongated shank portion, the piston member disposed within said internal chamber of said hollow housing such that the elongated shank portion projects outwardly from said large wide opening of said base, the enlarged upper portion having a top end with a recess and a circumferential sidewall with two spaced apart annular recesses, the elongated shank portion having an internal threaded aperture adjacent to a bottom end of the piston member;

d. a threaded fastener having an upper portion with screw threads, a middle flange and a lower portion with screw threads, the middle flange having an upper surface and a lower surface, where the upper portion is threadedly screwed into said internal threaded aperture of said elongated shank portion such that the upper surface of said middle flange abuts against said bottom end of said piston member;

e. two "O" rings inserted respectively into said two spaced apart annular recesses of said circumferential sidewall of said piston member for engaging with said interior surface of said circumferential sidewall of said hollow housing;

f. a biasing spring disposed within said interior chamber said hollow housing and engaged between said interior surface of said top of said hollow housing and said recess at said top end of said piston member;

g. a cushioning pad disposed on said elongated shank of said piston member for cushioning said piston member;

h. a generally flat keeper ring disposed on said elongated shank portion of said piston member and engaged with a stepped portion of said interior surface of said circumferential sidewall of said hollow housing for securing and permitting rotation of said hollow housing;

i. a C-shaped retaining ring placed within said annular groove of said interior surface of said circumferential sidewall of said hollow housing for further securing said keeper ring and said piston member within said internal chamber of said hollow housing; and j. a multiplicity of bird shot filled within said internal chamber of said hollow housing for absorbing the vibrations, shock and noise from said compound bow;

k. whereby said lower portion of said threaded fastener is screwed into said threaded opening of said compound bow, and thereby said damping member absorbs said vibrations and said shock in the longitudinal and lateral directions and damping said noise from said compound bow.

27. The invention as defined in claim 26 further comprising a plastic cap for covering said top of said hollow housing.

28. The invention as defined in claim 26 wherein said multiplicity of bird shot is #10 bird shot.

29. The invention as defined in claim 26 wherein additional weight can be added to said apparatus by screwing the weight into said small central threaded aperture at said top of said hollow housing.

30. The invention as defined in claim 26 wherein, said two "O" rings and said cushioning pad are made of rubber material.

31. A damping means for attachment to a compound bow which has a threaded opening, the damping means used for adsorbing vibrations and shock in both the longitudinal and lateral directions and damping the noise of the compound bow caused by the release of an arrow, the damping means comprising:

a. a generally cylindrical hollow housing having a top, a circumferential sidewall and a base with a large wide opening, the top having an exterior surface with a small central threaded aperture and an interior surface, the circumferential sidewall having an interior surface which together with the interior surface of the top defines an internal chamber;

b. an annular groove located on said interior surface of said circumferential sidewall of said hollow housing adjacent to said base of said hollow housing;

c. a generally cylindrical piston member having an enlarged upper portion and an elongated shank portion with external screw threads, the piston member disposed within said internal chamber of said hollow housing such that the elongated shank portion projects outwardly from said large wide opening of said base, the enlarged upper portion having a top end with a recess and a circumferential sidewall with two spaced apart annular recesses;

d. two "O" rings inserted respectively into said two spaced apart annular recesses of said circumferential sidewall of said piston member for engaging with said interior surface of said circumferential sidewall of said hollow housing;

e. a biasing spring disposed within said interior chamber of said hollow housing and engaged between said interior surface of said top of said hollow housing and said recess at said top end of said piston member;

f. a cushioning pad disposed on said elongated shank of said piston member for cushioning said piston member;

g. a generally flat keeper ring disposed on said elongated shank portion of said piston member and engaged with a stepped portion of said interior surface of said circumferential sidewall of said hollow housing for securing and permitting rotation of said hollow housing;

h. a C-shaped retaining ring placed within said annular groove of said interior surface of said circumferential sidewall of said hollow housing for further securing said keeper ring and said piston member within said internal chamber of said hollow housing; and i. a multiplicity of bird shot filled within said internal chamber of said hollow housing for absorbing the vibrations, shock and noise from said compound bow;

j. whereby said elongated shank portion of said piston member is screwed into said threaded opening of said compound bow, and thereby said damping member absorbs said vibrations and said shock in the longitudinal and lateral directions and damping said noise from said compound bow.

32. The invention as defined in claim 31 further comprising a plastic cap for covering said top of said hollow housing.

33. The invention as defined in claim 31 wherein said multiplicity of bird shot is #10 bird shot.

34. The invention as defined in claim 31 wherein additional weight can be added to said apparatus by screwing the weight into said small central threaded aperture at said top of said hollow housing.

35. The invention as defined in claim 31 wherein said two "O" rings and said cushioning pad are made of rubber material.

36. A damping means for an archery bow having a threaded opening, comprising:

a. a housing having a top, a sidewall and a base with an opening, the top having an exterior surface with a threaded aperture and an interior surface, the sidewall having an interior surface which together with the interior surface of the top defines a hollow chamber, the interior surface of the sidewall having an annular groove;

b. a piston means having an upper portion and a shank portion, the upper portion having a top end and a sidewall;

c. means for connecting said shank portion of said piston means to said archery bow;

d. means for engaging between said top of said housing and said top end of said piston means;

e. means for cushioning said piston means;

f. means for securing said piston means within said hollow chamber of said housing; and g. means for absorbing the vibrations, shock and noise from said archery bow;

h. whereby said damping means is screwed into said archery bow, and thereby said damping means absorbs said vibrations and said shock in the longitudinal and lateral directions and damping said noise from said archery bow.

37. The invention as defined in claim 36 further comprising a plastic cap for covering said housing.

38. The invention as defined in claim 36 herein said means for connecting said shank portion of said piston means to said archery bow includes a threaded fastener which has an upper portion with screw threads and a lower portion with screw threads, where the upper portion is threadedly screwed into the internal screw threads of said shank portion of said piston means and the lower portion is threadedly screwed into a threaded opening on said archery bow.

39. The invention as defined in claim 36 wherein said means for connecting said shank portion of said piston means includes external screw threads on said shank portion of said piston means such that said shank portion is threadedly screwed into a threaded opening on said archery bow.

40. The invention as defined in claim 36 wherein said means for engaging between said top of said housing and said piston means includes a biasing spring.

41. The invention as defined in claim 36 wherein said means for cushioning said piston means includes a rubber cushioning pad.

42. The invention as defined in claim 36 wherein said means for securing said piston means within said hollow chamber of said damping means includes a keeper ring and a C-shaped retaining ring which are placed around said shank portion of said piston means such that the C-shaped retaining ring is inserted into said annular groove of said interior surface of said sidewall.

43. The invention as defined in claim 36 wherein said means for absorbing said vibrations, shock and noise from said .archery bow includes a multiplicity of bird shot which are filled within said hollow chamber of said housing.

44. The invention as defined in claim 43 wherein said multiplicity of bird shot is #10 bird shot.

45. An indexed bolt for an archery bow having a threaded opening, comprising:

a. a washer having a top surface with a scale, a rear surface and a concave cavity, the washer having means for keeping it from moving on said archery bow; and b. a bolt having a nut portion and a shank portion with screw threads for threadedly engaging into said threaded opening of said archery bow, the nut portion having a convex base which mates with said concave cavity of said washer and means for indicating with said scale on said washer;

c. whereby when said washer is placed on said archery bow, and said bolt is screwed into said archery bow such that said convex base of said bolt is engaged with said concave cavity of said washer, the poundage on said archery bow can be adjusted by reading said scale on said washer.

46. The invention as defined in claim 45 wherein said means for keeping said washer from moving on said archery bow includes two small pins which project downwardly on said rear surface.

47. The invention as defined in claim 45 wherein said nut portion of said bolt has a generally hex nut shape.

48. The invention as defined in claim 46 wherein said nut portion of said bolt has a top with a threaded aperture such that a damping means can be threadedly mounted therein.

* * * * *